US007331918B2

(12) United States Patent
Hayasaka et al.

(10) Patent No.: US 7,331,918 B2
(45) Date of Patent: Feb. 19, 2008

(54) CENTRIFUGAL SEPARATOR WITH SAFETY FEATURES

(75) Inventors: Hiroshi Hayasaka, Ibaraki (JP); Kazuhiko Murayama, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/105,358

(22) Filed: Apr. 14, 2005

(65) Prior Publication Data

US 2005/0233884 A1 Oct. 20, 2005

(30) Foreign Application Priority Data

Apr. 16, 2004 (JP) ..... P 2004-149786

(51) Int. Cl.
*B04B 7/02* (2006.01)
*B04B 7/06* (2006.01)

(52) U.S. Cl. ..... 494/12; 494/16; 494/60

(58) Field of Classification Search ..... 494/12, 494/16–21, 31–34, 13–14, 43, 60–61, 85; 210/360.1

See application file for complete search history.

(56) References Cited

U.S. PATENT DOCUMENTS 2,608,344 A * 8/1952 Pickels ..... 494/1
2,885,188 A * 5/1959 Pickels et al. ..... 494/10
3,339,836 A * 9/1967 Mitchell et al. ..... 494/16
4,054,243 A * 10/1977 Volkov et al. ..... 494/12
4,196,844 A * 4/1980 Jacobson ..... 494/12
4,568,325 A * 2/1986 Cheng et al. ..... 494/84
4,693,702 A * 9/1987 Carson et al. ..... 494/61
4,753,630 A * 6/1988 Romanauskas ..... 494/9
5,538,492 A * 7/1996 Potter ..... 494/12
5,855,545 A * 1/1999 Kishi et al. ..... 494/12
6,063,017 A * 5/2000 Romanauskas et al. ..... 494/12
2005/0233884 A1* 10/2005 Hayasaka et al. ..... 494/60
2005/0272587 A1* 12/2005 Niinai ..... 494/12

FOREIGN PATENT DOCUMENTS

DE 10233537 A1 * 2/2004
EP 0015047 A1 * 9/1980
JP 2000-492 * 1/2000
JP 2001-104827 4/2001
JP 2001-104833 * 4/2001
JP 2001-219098 * 8/2001
JP 2005-230744 * 9/2005

* cited by examiner

*Primary Examiner*—Charles E. Cooley
(74) *Attorney, Agent, or Firm*—McGinn IP Law Group, PLLC

(57) ABSTRACT

In a centrifugal separator, inside a housing opposed to a protector, a protruding member, which protrudes inside, is arranged at a position shifted from a shortest distance portion, the distance from the protector of which is the shortest, so that a spatial distance between the housing and the protector can be reduced.

18 Claims, 8 Drawing Sheets

CENTRIFUGAL SEPARATOR WITH SAFETY FEATURES

BACKGROUND OF THE INVENTION

1. Field of the Invention

The present invention relates to a structure for ensuring safety of a rotation body (rotor) of a centrifugal separator.

2. Description of the Related Art

In a centrifugal separator, a rotor, which is a body of rotation into which a sample to be separated is put, is rotated at high speed. Therefore, in case of emergency in which the rotor is broken while it is rotating, a high intensity of breaking energy is generated. As a demand for safety with respect to a centrifugal separator used in a laboratory is stipulated in IEC61010-2-0202 which is the international standard, it is demanded that the structure can ensure safety even when half of a rotor is broken when the rotor is rotated at high speed if the worst accident to be estimated happens. Specifically, it is required that pieces of the rotor are confined and a movement of the device is restricted.

As a conventional means for confining this breaking energy, a protector (protective barrier) is provided on the outer circumference of a rotor chamber so as to absorb the breaking energy of a large broken piece of the rotor. In the case of a centrifugal separator in which a living thing sample (e.g. blood) is treated, a cooling pipe for directly cooling the rotor chamber is wound round the outer circumference of the rotor chamber so that the rotor can be cooled. The outer circumference is tightly closed by heat insulating material such as foam material so that the heat radiation and dew condensation can be prevented. The protector is arranged further on the outer circumference. Thickness of the protector and how to arrange the protector in a frame (housing) are designed according to an intensity of the rotary energy of the rotor.

An example of the related art is shown in FIGS. 5, 6 and 7. When an intensity of the breaking energy to be confined is high, it is necessary to increase the thickness of the protector 55. When the protector 55 is sufficiently thick, it is possible to confine the breaking energy by minimizing a deformation of the protector 55. On the other hand, the assemblability of the centrifugal separator is deteriorated and further the weight of the centrifugal separator is increased, which is not appropriate for practical use.

Therefore, in order to absorb the breaking energy, the protector 55 is deformed or rotated when the rotor 57 is broken. In order to deform or rotate the protector 55 when the rotor 57 is broken, that is, in order to move the protector 55, which has been deformed by the pieces of broken rotor 57*a*, 57*b* in the frame (housing) 52 in the rotary direction 62 of the rotor and in order to prevent the frame 52 from being deformed by the protector 55 which has been deformed, it is necessary to ensure a fairly large space in the frame between the inner face 52*a* of the frame and the protector 55 so that the protector 55 does not come into contact with the inner face 52*a* of the frame even when the protector 55 is deformed by the pieces of the broken rotor 57*a*, 57*b* and rotated in the rotary direction 62.

For the above reasons, it is necessary to provide a space in a main body of the centrifugal separator for accommodating a cooling unit and the protector and also to provide a space to allow the protector to be deformed in the main body of the centrifugal separator except for the space in which the rotor chamber is accommodated. Therefore, it is difficult to make the centrifugal separator smaller to save the space. A refrigerating machine to be used as the cooling unit, in which refrigerant is used, is mounted on the centrifugal separator in many cases. Therefore, countermeasures are taken for preventing the electric parts from being affected by a rise in the temperature inside the centrifugal separator caused by the heat generated when the refrigerating machine is operated. For example, a controller section 51 in which the electric parts are mounted is arranged on the side of the rotor chamber separate from the chamber in which the refrigerating machine is arranged. Alternatively, the board, on which the electronic parts are mounted, and the electric parts are arranged in the centrifugal separator main body in a dispersed manner.

SUMMARY OF THE INVENTION

In the case where the controller section 51 is arranged on the side of the rotor chamber, since the controller section 51 is placed at one position, the assemblability is high. However, in addition to the structure described before by which the breaking energy is confined, it becomes necessary to provide a space to accommodate the controller section 51, and the main body of the centrifugal separator is made larger. Further, when the board, on which the electronic parts are mounted, and the electric parts are arranged being dispersed, the assembling work of the centrifugal separator becomes complicated and the manufacturing cost tends to increase.

It is an object of the present invention to solve the above problems of the related art and provide an inexpensive centrifugal separator in which the space in the main body is saved and it is easy to manufacture the centrifugal separator.

The above object can be accomplished by a centrifugal separator including: a drive unit; a rotor driven and rotated by the drive unit; a rotor chamber for accommodating the rotor; a protector arranged on an outer circumference of the rotor chamber; a frame for accommodating the rotor chamber and the protector; and a clearance reducing member that reduces a clearance between the frame and the protector, wherein the clearance reducing member is arranged at a position shifted from a shortest distance portion at which a distance between the protector and an inner face of the frame is the shortest.

According to the present invention, it is possible to reduce a space which is necessary to allow the protector to be deformed. Further, even when the controller is crushed a little by the deformation of the protector, it is difficult for the electric circuit to be exposed to a dangerous state. Therefore, a distance from the controller section to the protector can be shortened. As a result, it becomes possible to save the space of the main body of the centrifugal separator, and the centrifugal separator can be easily manufactured and the cost can be reduced.

DETAILED DESCRIPTION OF THE PREFFERED EMBODIMENTS

Figure 1:
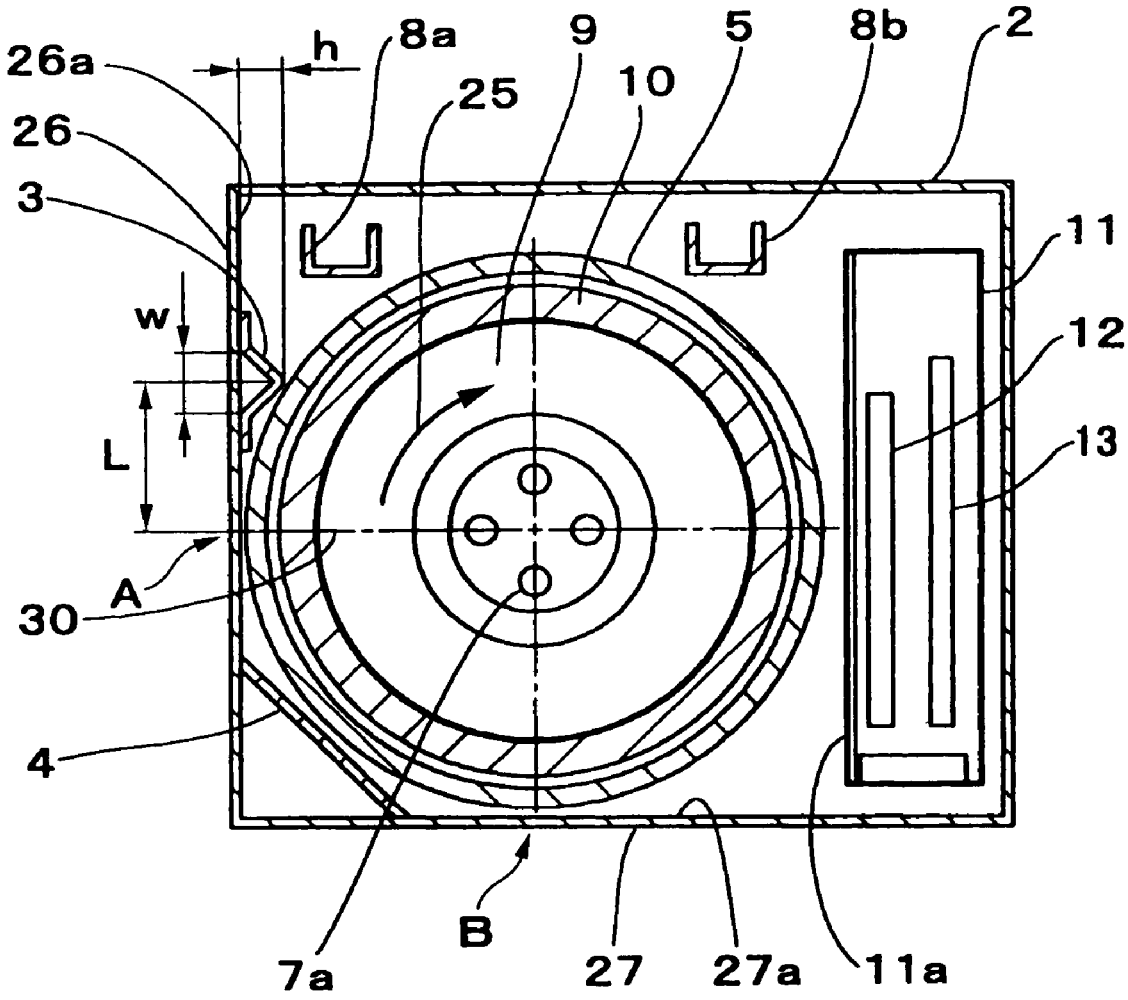
FIG. 1 is a transverse sectional view showing a centrifugal separator according to an embodiment of the present invention.
Figure 2:
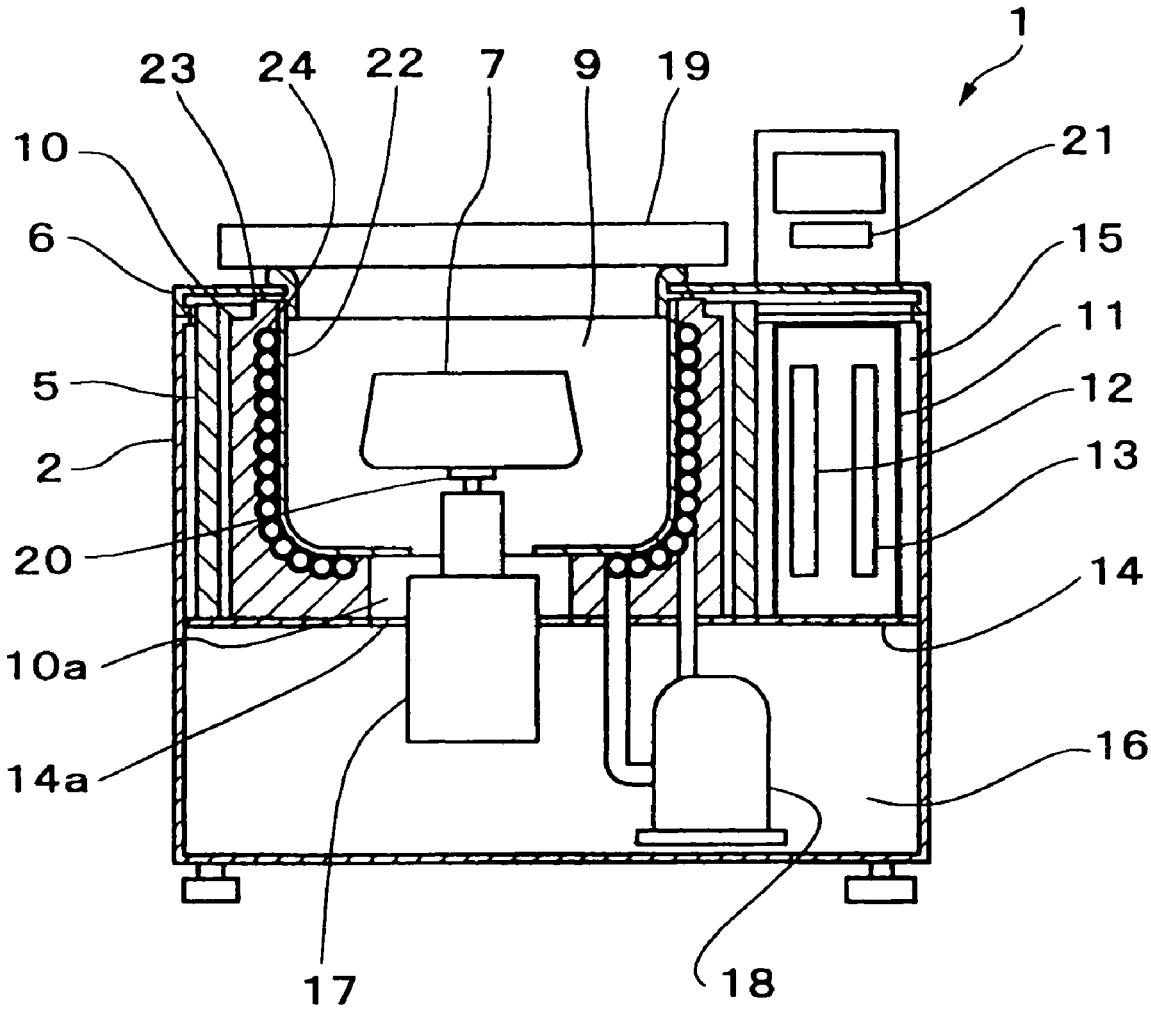
FIG. 2 is a vertical sectional view showing the embodiment of the centrifugal separator.

FIG. 1 is a transverse sectional view of an embodiment of the centrifugal separator 1 of the present invention, and FIG. 2 is a vertical sectional view. In a frame (housing) 2, a partition plate 14 is provided so that the frame 2 can be divided into two portions including upper and lower portions. An upper chamber 15 and a lower chamber 16 are defined by the frame 2 and the partition plate 14. On the partition plate 14, a substantially circular opening 14*a* is formed. A rotor chamber section 10 is arranged on the partition plate 14 so that this opening 14*a* and a substantially circular opening 10*a*, which is formed in the bottom portion of the rotor chamber section 10 having a cylindrical casing not shown, are concentrically arranged.

A portion of the rotor chamber section 10 close to the opening portion 10*a* is fixed to the partition plate 14 by screws not shown in the drawing. Further, on the outer circumference of the rotor chamber section 10, a protector (protective barrier) 5 is arranged. The protector is prevented from being moved in the lateral direction at the time of breakdown of the rotor by a plurality of L-shaped stoppers (not shown) provided on the partition plate 14. Further, the protector is prevented from being shifted by the plurality of L-shaped stoppers while the centrifugal separator is being transported. However, since the protector is not restricted in a rotary direction 25 of the rotor, the protector can be rotated. Of course, the protector can be rotated in a reverse direction to the rotary direction 25 of the rotor.

The rotor chamber section 10 is constructed in such a manner that foam material 23 is filled between a bowl 22, which forms a rotor chamber 9, and the cylindrical casing not shown, so that these parts can be integrated with each other into one body. An evaporator 24 that has pipes wound around the rotor chamber and made of copper for circulating the refrigerant to cool the rotor chamber 9 is fixed to the outer circumferential portion of the bowl 22 by means of soldering. In the opening 10*a* of the rotor chamber section and the opening 14*a* of the partition plate, the drive motor 17, which is a means for driving the rotor 7, is fixed to the partition plate 14 via a plurality of vibration isolation rubber pieces and a motor base not shown by means of screwing.

Further, on one side of the protector 5, a controller section 11 for controlling the entire centrifugal separator 1 is arranged. A control board 12 for controlling the centrifugal separator according to the inputted operating condition and according to signals sent from various sensors, and a drive board 13 for supplying electric power to the drive motor 17 are arranged inside the controller section 11. Further, in the upper portion of the frame 2, an opening is provided which is used when the rotor chamber section 10 and the protector 5 are incorporated into the frame 2. Furthermore, a table 6 is arranged in such a manner that it covers this opening portion.

A door 19 capable of being opened and closed is provided on the upper portion of the rotor chamber 9. A crown portion 20 is provided at the forward end portion of the drive motor 17, and a rotor 7 having a sample holding section 7*a* is detachably supported by the crown portion 20. There are provided a plurality of types of rotors 7. For example, FIG. 2 shows a rotor 7 referred to as an angle rotor. Except for the angle rotor, there are provided rotors referred to as a swing rotor and vertical rotor. The size of the rotor 7 changes according to a volume of the sample to be mounted on the rotor.

In the lower chamber 16, a refrigerating machine 18 is arranged which is used for compressing and circulating the refrigerant to cool the rotor chamber 9. In the lower chamber 16, a radiator and fan not shown are also arranged which are used for cooling the refrigerant compressed and cooled by the refrigerating machine 18.

The operating conditions such as the rotation speed, operation time, setting temperature and rotor ID (number) for specifying a rotor type are inputted from an input section 21 of the centrifugal separator 1. The controller section 11, which is a control unit of the centrifugal separator, reads out and compares the thus inputted operating conditions with the specification data (for example, the maximum allowed rotation speed, the temperature correction coefficient and so forth) which are previously stored in a storage section provided on the control board 12. According to the result of the comparison, it is judged whether or not the selected rotor 7 can be operated by the inputted operating conditions.

The centrifugal separator 1 must absorb the rotary energy when the rotor, the rotating energy of which is the highest in the rotors capable of being used for the centrifugal separator 1, is broken. Further, the centrifugal separator 1 must prevent pieces of the rotor from flying outside the centrifugal separator and suppress the main body from moving.

Between the frame 2 and the protector 5, a clearance (a small space) used for attaching the protector 5 is formed. At a position which is shifted from a portion where the distance between a left inner face 26*a* of the frame and the protector 5 is the shortest, the distance between the left inner face 26*a* of the frame and the protector 5 is gradually increased. In this portion, a protruding member 3, the shape of which is triangular, for reducing the clearance between the frame 2 and the protector 5 is attached by means of welding so that the protruding member 3 can be integrated with the frame 2 into one body.

In this embodiment, at a position distant from the shortest distance section A (a portion in which a left side 26 of the frame 2 and the centerline 30 of the protector 5 cross each other making a right angle) located between the left inner face 26*a* of the frame and the protector 5 by 131 mm (L), the triangular protruding member (protrusion), the height (h) of which is approximately the same as the clearance between the protector 5 and the left inner face 26*a* of the frame, the width (w) of which is 58 mm, is provided so that the minimum clearance between the forward end portion of the protruding member 3 and the protector 5 is set to be a distance not more than 5 mm.

Further, between a front side 27 of the frame and the left side 26 of the frame, a corner member 4 (protrusion) is provided which reduces a clearance between the frame 2 and the protector 5. With this corner member 4, the same effects as in the case where two protruding members 3 (not shown) are respectively provided on the front and left sides 27, 26 in the vicinity of this corner can be obtained. The corner member 4 is arranged so that the minimum clearance between the corner member 4 and the protector 5 is set to be not more than 5 mm. On the back side of the centrifugal separator, a large space is previously provided. In this embodiment, members 8*a*, 8*b*, the cross-sectional shapes of which are C-shaped, are arranged for the same purpose as that of the protruding member 3.

On the right of the protector 5, the controller section 11, which is a control circuit of the centrifugal separator 1, is arranged. The controller section 11 includes: a control board 12 (board) mainly composed of a light electric circuit (circuit of low voltage having no possibility of electrification) for controlling the centrifugal separator 1 according to the inputted operating condition and according to the signals sent from various sensors; and a drive board 13 (board) mainly composed of a heavy electric circuit (circuit of high voltage having a possibility of electrification) for supplying electric power to the drive motor 17 which rotates the rotor 7. The control board 12 is mounted on the side close to the protector 5, and the drive board 13 is mounted on the frame 2 side. The controller section 11 has a box-like shape. After the control board 12 and the drive board 13 are incorporated into the controller section 11, the controller section 11 is placed in the frame 2 and necessary wiring is conducted. A cover 11*a* is then provided which closes an opening portion of the controller section 11.

Figure 3:
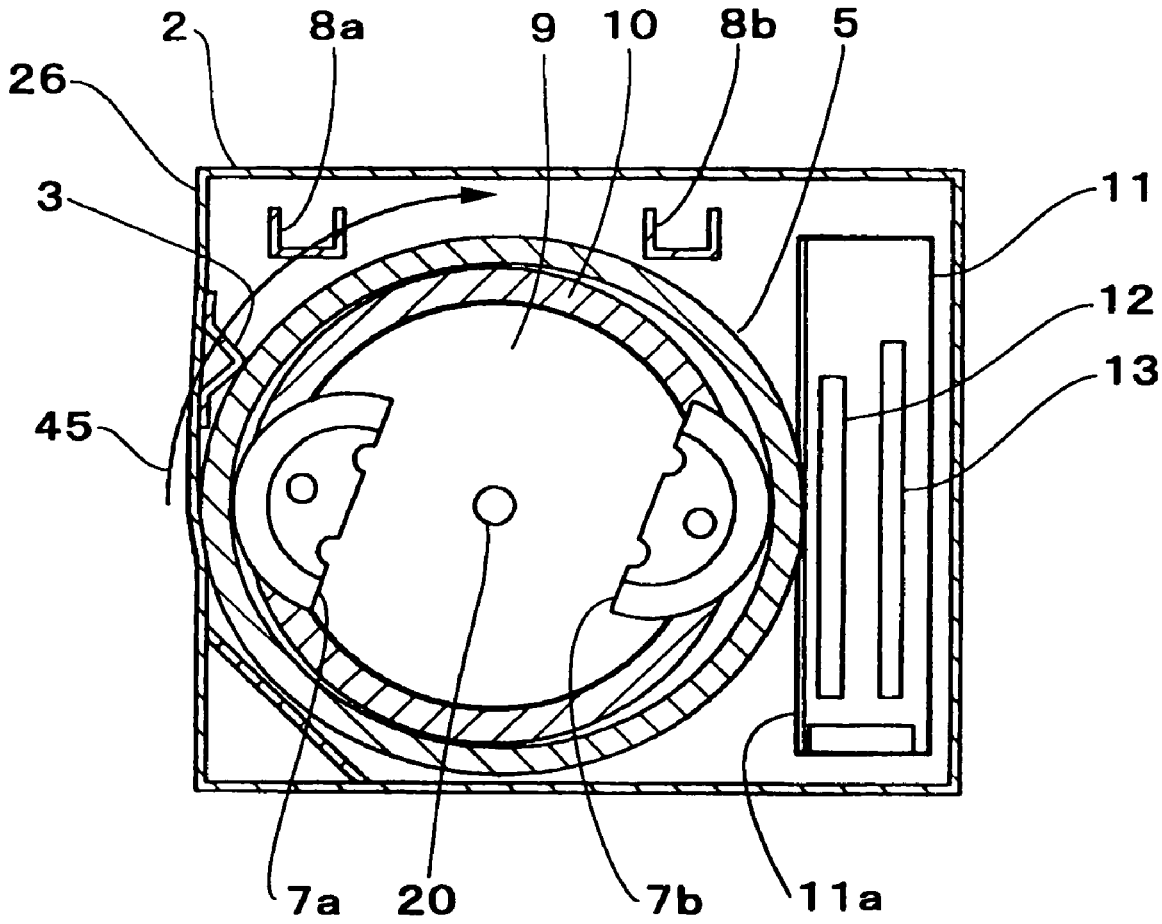
FIG. 3 is a transverse sectional view showing a deformation of a protector when a rotor is broken in the embodiment.
Figure 4:
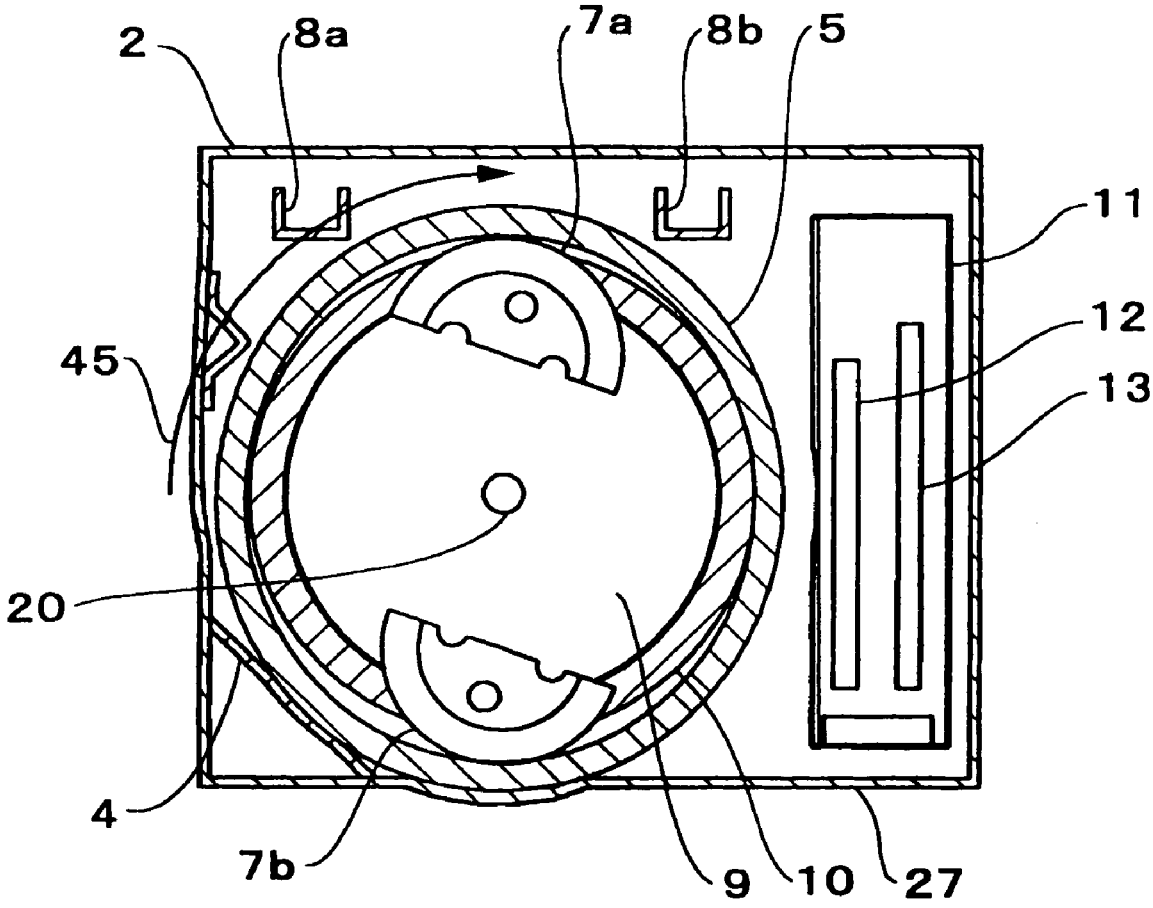
FIG. 4 is a transverse sectional view showing a behavior of the protector when the rotor is broken in the embodiment.
Figure 5:
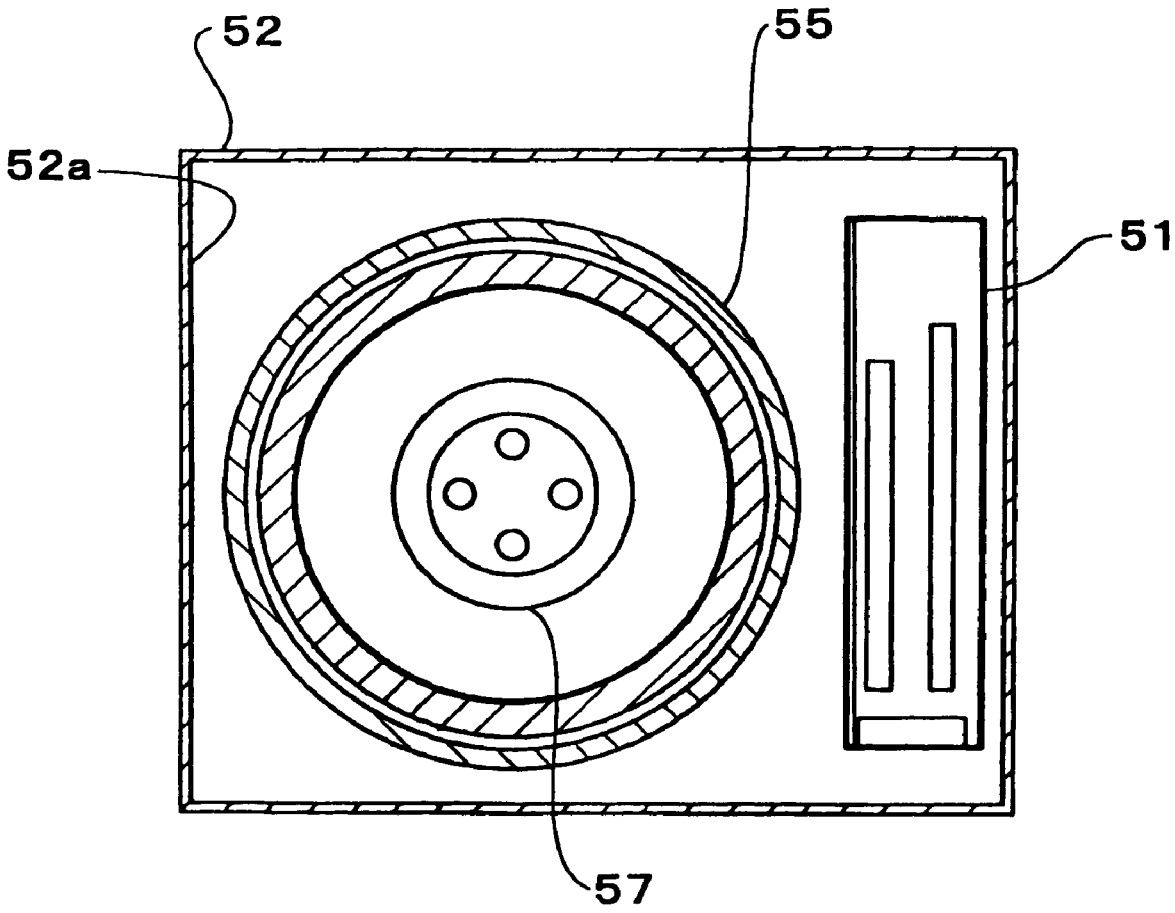
FIG. 5 RELATED ART
FIG. 5 is a transverse sectional view showing an example of a centrifugal separator in the related art.
Figure 6:
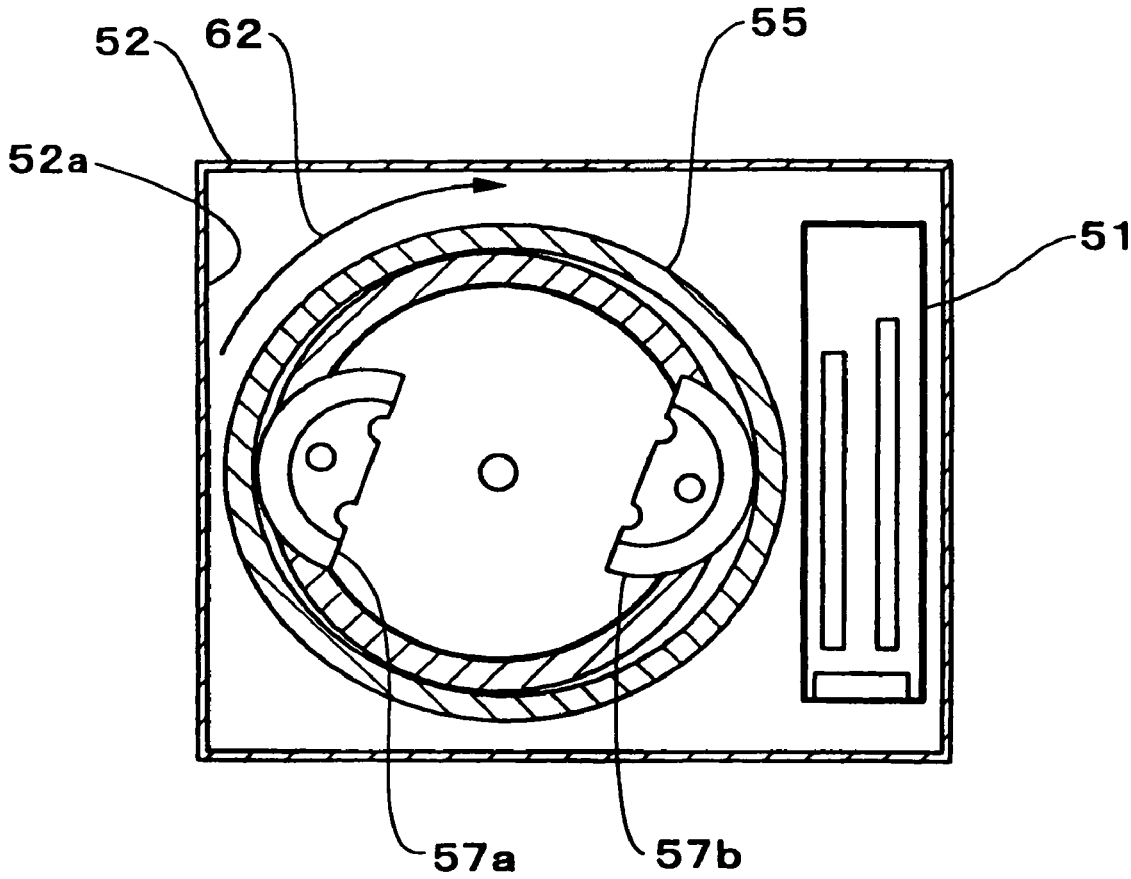
FIG. 6 RELATED ART
FIG. 6 is a transverse sectional view showing a deformation of a protector when a rotor is broken in the example.
Figure 7:
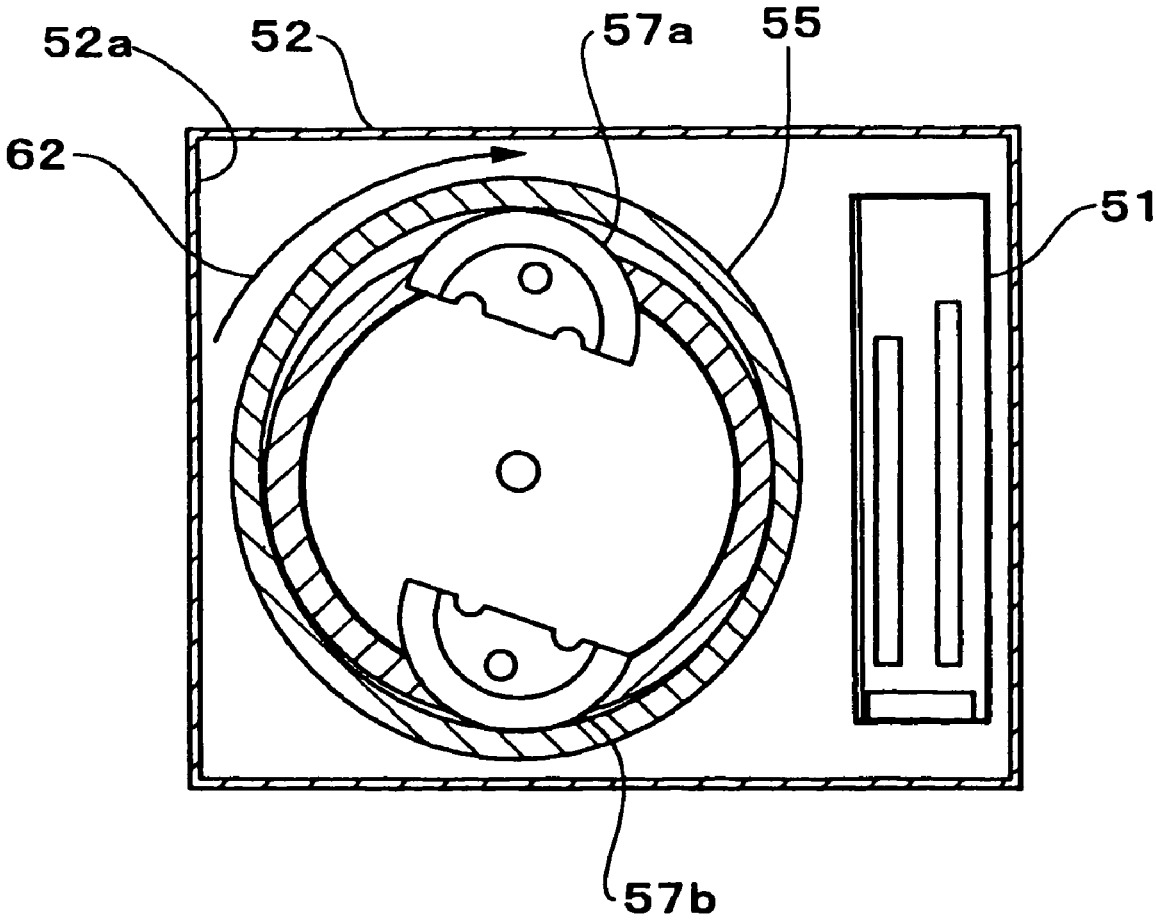
FIG. 7 RELATED ART
FIG. 7 is a transverse sectional view showing a behavior of the protector when the rotor is broken in the example.

As explained above, in the worst accident to be estimated, it is in the mode in which the rotating rotor 7 is broken into two pieces. FIGS. 3 and 4 are transverse sectional views showing a deformation and behavior of the protector 5 caused by the pieces 7*a*, 7*b* of the rotor when the rotor 7 has been broken. As shown in FIG. 3, the pieces 7*a*, 7*b* of the broken rotor fly out in the tangential direction of the rotation of the rotor and collide with the rotor chamber 10 having the bowl 22 and also collide with the protector 5.

The thickness of the protector 5 is determined in such a manner that although the protector 5 is deformed by the pieces 7*a*, 7*b* of the broken rotor, the pieces 7*a*, 7*b* of the broken rotor do not penetrate the protector 5 so that the breaking energy of the pieces 7*a*, 7*b* of the broken rotor can be sufficiently received by the protector 5. Therefore, in the case where an intensity of the breaking energy is high, the deformed protector 5 collides with the frame 2 located outside the protector 5, and the frame 2 is deformed.

Deformation of the protector 5 caused by the collision of the pieces of the rotor is different according to the circumstances in which the rotor was broken. In the worst case of deformation with respect to the frame 2, the portions A and B, in which the distance from the frame 2 to the protector 5 is the shortest, are deformed. In this embodiment, the worst cases of deformation are caused between the protector 5 and the left inner face 26*a* of the frame and also between the protector 5 and the front inner face 27*a* of the frame.

The deformed protector 5 first collides with the frame 2. At the same time, the deformed protector 5 is given torque from the rotor 7 and moved in a rotary direction 45. At this time, the deformed protector 5 also collides with the protruding member 3. Further, when the deformed protector 5 is rotated in the rotary direction 45, as shown in FIG. 4, the deformed protector 5 also comes into contact with the front side 27 of the frame and the corner member 4, and the front side 27 of the frame and the corner member 4 are deformed.

Accordingly, a force to deform the frame 2 by the deformed protector 5 is dispersed to forces to deform the left face 26 of the frame, the protruding portion 3, the front side 27 of the frame and the corner member 4. As a result, this force is dispersed to the entire frame 2. Therefore, the deformation of the frame 2 can be suppressed small. When the deformation of the frame 2 can be suppressed small, it becomes possible to suppress the generation of the clearance in the connecting portion of the upper face of the frame 2 with the table 6. Accordingly, small pieces of the rotor can be confined.

Concerning the controller section 11 side, in the same manner, the cover section 11*a* of the controller section 11 is deformed by the deformed protector 5. The deformed cover 11*a* might crush the control board 12. However, since the control board 12 itself is a light electric circuit or a circuit insulated from the electric power source, even when the control board comes into contact with the frame 2 side, a portion where the operator touches with the hand is insulated from the electric power source. Therefore, it is possible to avoid the danger of electrification.

Figure 8:
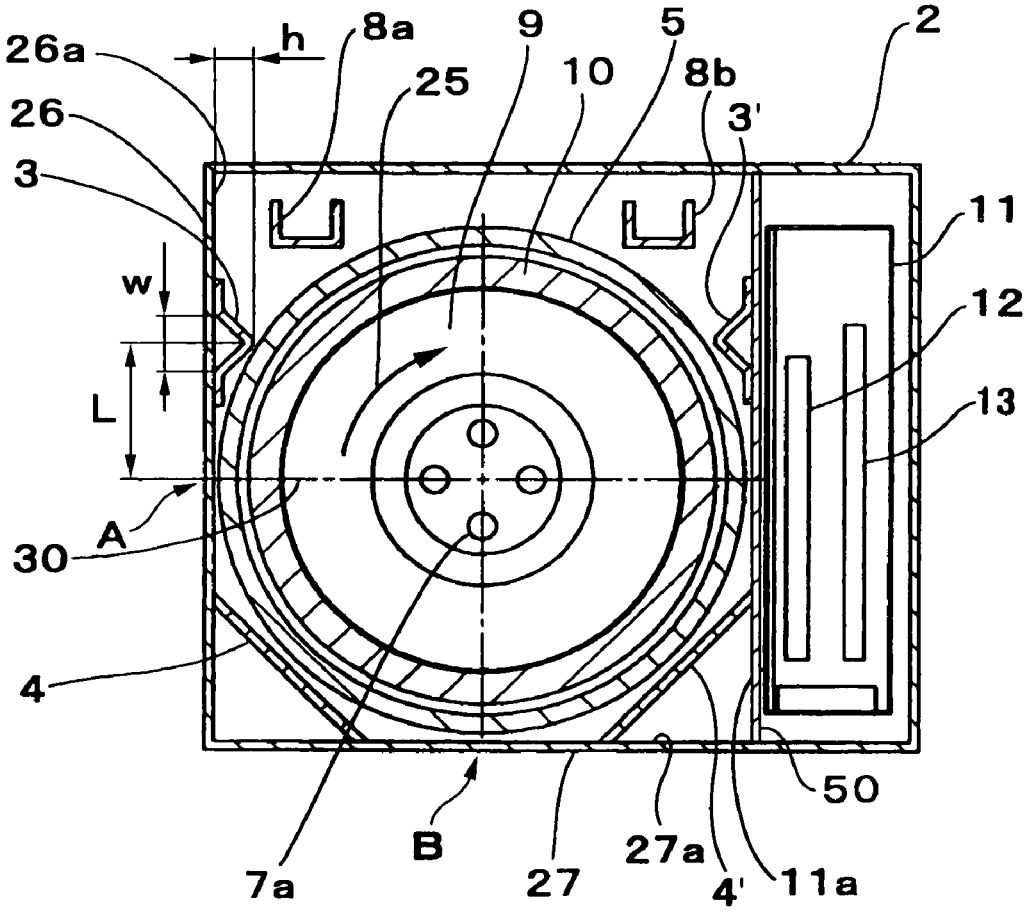
FIG. 8 is a transverse sectional view showing a centrifugal separator according to another embodiment of the present invention.

In this connection, since the drive board 13 having a heavy electric circuit is arranged at a position where the drive board 13 is not affected by the deformed protector 5, no influence is given to the drive board 13 by the deformed protector 5. Accordingly, there is no danger of leakage of electricity from the drive board 13. When a partitioning section 50 is provided which partitions the protector 5 from the controller section 11 by a plate-shaped frame and when a protruding member 3' and/or a corner member 4' is arranged as shown in FIG. 8, the space can be further reduced.

Further, when an arcuate member (protrusion) is provided in the frame so that a predetermined clearance can be formed on the outer circumference of the protector 5, the same effect can be provided.

As described above, even when the clearance between the protector 5 and the frame 2 is reduced, the breaking energy can be confined even in the case of the worst accident to be estimated. Accordingly, the main body of the centrifugal separator can be made smaller.

What is claimed is:

1. A centrifugal separator comprising:

a drive unit;

a rotor driven and rotated by the drive unit;

a rotor chamber for accommodating the rotor;

a protector arranged on an outer circumference of the rotor chamber;

a frame for accommodating the rotor chamber and the protector; and a clearance reducing member on said frame that reduces a clearance between the frame and the protector, wherein the clearance reducing member is arranged such that a minimum clearance between the clearance reducing member and the protector is not at a position corresponding to a shortest distance portion at which a distance between the protector and an inner face of the frame is the shortest.

2. The separator of claim 1, wherein said clearance reducing member extends from a front inner face to one of a side inner face of said frame.

3. The separator of claim 1, wherein said clearance reducing member extends inwardly from said frame toward said protector.

4. A centrifugal separator comprising:

a drive unit;

a rotor driven and rotated by the drive unit;

a rotor chamber for accommodating the rotor;

a protector arranged on an outer circumference of the rotor chamber;

a frame for accommodating the rotor chamber and the protector; and a clearance reducing member that reduces a clearance between the frame and the protector, wherein the clearance reducing member is arranged at a position shifted from a shortest distance portion at which a distance between the protector and an inner face of the frame is the shortest, and wherein a shape of the clearance reducing member is triangular in a plan view.

5. A centrifugal separator comprising:

a drive unit;

a rotor driven and rotated by the drive unit;

a rotor chamber for accommodating the rotor;

a protector arranged on an outer circumference of the rotor chamber;

a frame for accommodating the rotor chamber and the protector;

a controller section for controlling the centrifugal separator, arranged between the protector and the frame;

a partitioning section for partitioning the controller section and the protector;

a first clearance reducing member that reduces a clearance between the partitioning section and the protector; and a second clearance reducing member that reduces a clearance between the frame and the protector.

6. The centrifugal separator according to claim 5, wherein said control section includes a first board of a light electric circuit or a circuit insulated from an electric power source, and a second board of a heavy electric circuit or a circuit not insulated from an electric power source, and wherein said second board is positioned further away from the partition than the first board.

7. The separator of claim 5, wherein said first clearance reducing member extends from said partitioning section toward said protector.

8. A centrifugal separator comprising:

a protector surrounding a rotor; and a frame surrounding the protector, wherein the frame comprises a clearance reducer that reduces the clearance between the frame and said protector such that a minimum clearance between the clearance reducer and the protector is at not a position corresponding to a shortest distance portion at which a distance between the protector and the frame is the shortest.

9. The separator of claim 8, wherein said clearance reducer extends from an inner face of said frame toward said protector.

10. The separator of claim 8, wherein said clearance reducer is offset on said frame from a position where an inner face of said frame is closest to said protector.

11. The separator of claim 8, wherein a clearance between said clearance reducer and said protector is substantially the same as the shortest clearance between an inner face of said frame and said protector.

12. The separator of claim 8, wherein said clearance reducer extends from a front face of said frame and one of a side face of said frame.

13. A centrifugal separator comprising:

a protector surrounding a rotor; and a frame surrounding the protector, wherein the frame comprises a clearance reducer that reduces the clearance between the frame and said protector, and wherein a shape of said clearance reducer is triangular in a plan view.

14. A centrifugal separator comprising:

a protector surrounding a rotor; and a frame surrounding the protector, wherein the frame comprises a clearance reducer that reduces the clearance between the frame and said protector, and wherein the frame further comprises a partition that separates said rotor and a controller and wherein said clearance reducer extends from said partition toward said protector.

15. The separator of claim 14, wherein the clearance reducer extends from a front face of said frame and said partition.

16. The separator of claim 14, wherein said controller comprises a control board that is insulated from a power source and a drive board, wherein said drive board is positioned further away from said partition than said control board.

17. A centrifugal separator comprising:

a drive unit;

a rotor driven and rotated by the drive unit;

a rotor chamber for accommodating the rotor;

a protector arranged on an outer circumference of the rotor chamber;

a frame for accommodating the rotor chamber and the protector, said frame including a first portion at which a distance between the protector and an inner face of the frame is the shortest and a second portion where the distance between the protector and the inner face of the frame is gradually increased, and a clearance reducing member that is disposed on the second portion of the frame and extends toward the protector to reduce a clearance between the clearance reducing member and the protector.

18. The centrifugal separator as defined in claim 17, wherein the minimum clearance between the clearance reducing member and the protector is set to be a distance not more than 5 mm.

* * * * *